US009469957B2

(12) United States Patent
Lee et al.

(10) Patent No.: US 9,469,957 B2
(45) Date of Patent: Oct. 18, 2016

(54) PNEUMATIC LOAD-TRANSFER SYSTEM AND METHOD FOR MATING AN INTEGRATED DECK WITH A PRE-INSTALLED PLATFORM SUBSTRUCTURE

(71) Applicant: China National Offshore Oil Corp., Beijing (CN)

(72) Inventors: James Lee, Houston, TX (US); Wen Jun Zhong, Tianjin (CN); Han Jun Yin, Tianjin (CN); Xin Zhong Li, Beijing (CN); Mo Fan, Beijing (CN); Xiao Hong Zhou, Beijing (CN); Yuan Lang Cai, Tianjin (CN); Xiao Long Yang, Tianjin (CN); Xiao Wei Zhang, Tianjin (CN); Liang Wang, Tianjin (CN)

(73) Assignees: China National Offshore Oil Corp., Beijing (CN); China Offshore Oil Engineering Co., Tianjin (CN)

( * ) Notice: Subject to any disclaimer, the term of this patent is extended or adjusted under 35 U.S.C. 154(b) by 235 days.

(21) Appl. No.: 14/187,298

(22) Filed: Feb. 23, 2014

(65) Prior Publication Data

US 2015/0240439 A1 Aug. 27, 2015

(51) Int. Cl.

| | |
|---|---|
| ***E02B 17/08*** | (2006.01) |
| ***E02B 17/02*** | (2006.01) |
| *E02B 17/00* | (2006.01) |

(52) U.S. Cl.
CPC ..... *E02B 17/024* (2013.01); *E02B 17/021* (2013.01); *E02B 17/08* (2013.01); *E02B 2017/0043* (2013.01); *E02B 2017/0047* (2013.01)

(58) Field of Classification Search
CPC ..... E02B 17/08; E02B 17/024; E02B 2017/0047
USPC ..... 405/195.1, 196, 200, 203–206, 209
See application file for complete search history.

(56) References Cited

U.S. PATENT DOCUMENTS 2,610,824 A * 9/1952 Grier ..... B66F 3/35 187/250

FOREIGN PATENT DOCUMENTS

JP 60-195215 A * 10/1985

* cited by examiner

*Primary Examiner* — Sunil Singh
(74) *Attorney, Agent, or Firm* — Tim Liu; Liu Law Group, PLLC

(57) ABSTRACT

A new pneumatic load transfer and shock absorbing system is disclosed. The pneumatic system includes a layer of air-bags to perform two basic functions during a floatover installation operation: 1) lifting the platform deck from the support to create additional air gaps at the mating surfaces, and the heave motions of the lifted platform deck may be reduced; 2) performing as a shock absorbing device with variable vertical stiffness easily controlled by the air-bag internal air pressure during the mating operation and the separation operation.

37 Claims, 14 Drawing Sheets

PNEUMATIC LOAD-TRANSFER SYSTEM AND METHOD FOR MATING AN INTEGRATED DECK WITH A PRE-INSTALLED PLATFORM SUBSTRUCTURE

FIELD OF THE INVENTION

The disclosure relates generally to a system for transferring an integrated offshore platform deck load from a vessel to a pre-installed platform substructure under rough seas or under swell conditions.

BACKGROUND OF THE INVENTION

Offshore Floatover Installation

An offshore platform is generally composed of two sections: 1) a substructure such as a jacket for a fixed platform, and 2) a superstructure such as a deck to be installed on the top of a substructure.

A floatover installation is referred to a set of offshore operational procedures to install an integrated platform deck onto a pre-installed substructure at an offshore location under open sea environments.

The first procedure is the transportation of a platform deck from an onshore fabrication yard to an offshore installation site. When a barge or a heavy transport vessel loaded with the integrated deck arrives at the offshore installation, the substructure should be already installed with a set of upwardly extending substructure legs to form a slot for the transport vessel to move into.

The second procedure is the docking procedure in which the transport vessel is moved in and docked with the pre-installed substructure upstanding legs. The transport vessel is maneuvered into the open slot so that the downwardly extending deck legs from the platform deck are aligned above the substructure upwardly extending legs. During this process, mooring lines and fendering system are usually employed. Prior to entering of the slot, in some cases, the platform deck could be lifted, such as in a Uni-deck floatover method described below, in order to increase the air gaps between the downwardly extending deck leg bottoms and the substructure upwardly extending leg tops. Once the alignment is within design requirements, ballasting of the transport vessel commences.

The third procedure is the mating procedure to transfer the load of the deck from the vessel deck supports on the transport vessel deck to the substructure upwardly extending legs. This is a critical phase of any floatover installations because the load transfer operation has to be conducted under wave induced vessel motions, especially heave motions. Impacts will occur between the deck downwardly extending legs and substructure upwardly extending legs and such repeated impacts may result in damages to both structures.

The fourth procedure involves separating the vessel from the platform deck and withdrawing the vessel from the substructure slot. This is another critical phase of the floatover installation. Once the majority of the deck load has been transferred to the substructure upwardly extending legs, due to the vessel ballasting induced vessel draft change, the deck starts to separate from the supports at the barge deck Immediately after the initial separation, the relative motions between the vessel and the deck may pose a potential danger of damages due to the impact between the two bodies induced by vessel motions.

The potential damage during the mating phase usually occurs at the contact surfaces (mating surfaces) between the downwardly extending deck legs and the substructure upwardly extending legs. The potential damage during the separating phase usually occurs at the contact surfaces (separating surfaces) between the support tops at the vessel deck and the associated deck bottom structure. Most systems and methods in prior art for floatover installations intend to introduce different systems or devices at these two above-mentioned surfaces.

Several methods and systems have been introduced in the prior art. U.S. Pat. No. 4,662,788 to Kypke et al., issued May 5, 1987, describes two different stiffness springs with the second spring rate higher than the first one at the mating surfaces to improve the mating operation. U.S. Pat. No. 4,729,695 to Silvestri, issued Mar. 8, 1988, describes a deck to substructure load transfer system, at both mating surfaces and separating surfaces, wherein hydro-pneumatic jacks and hydraulic lift cylinders, respectively, are used to raise and then lower the deck downwardly extending legs to the substructure upwardly extending legs. U.S. Pat. No. 4,761,097 to Turner, issued Aug. 2, 1988, describes a system at mating surfaces with a spud can and a sand pin for absorbing shock loading during the mating operation. At the separating surfaces, drop block assemblies, an active system, are introduced to create an immediate gap between the contact surfaces. U.S. Pat. No. 4,848,967 to Weyler, issued Jul. 18, 1989, describes a deck to substructure transfer system at mating surfaces wherein each of the deck leg includes a hydro-pneumatic cylinder and piston type actuator, producing different spring stiffness rates, in addition with stacked elastomeric disks which are compressed between the cylinders and the deck legs. At the separating surfaces, drop block assemblies are introduced to create an immediate gap between the contact surfaces. U.S. Pat. No. 4,930,938 to Rawstron et al, issued Jun. 5, 1990, describes a system at mating surfaces with primary and secondary load transfer devices and with stacked elastomeric elements. At the separating surfaces, drop block assemblies, an active system, are introduced to create an immediate gap between the contact surfaces. U.S. Pat. No. 5,219,451 to Datta et al, issued Jun. 15, 1993, describes a system at mating surfaces with plural spaced-apart annular elastomeric elements. At separating surfaces, elastomeric shock-absorbing pads, a passive system, are utilized to reduce the impact loads during the separating phase of the floatover installation. U.S. Pat. No. 5,522,680 to Hoss et al, issued Jun. 4, 1996, describes a hydraulic system at mating surfaces with cylinder and plunger assemblies and with controllable flow rates and directions. At separating surfaces, removable raft assemblies, an active system, are utilized to create quick gaps during the separating phase of floatover installations. This method and system aim to perform a floatover installation in swell conditions wherein the vessel is under high swell induced heave motions. One advantage in this method is that these expensive hydraulic cylinders and plungers can be reused for other floatover applications.

In any floatover installation methods and systems, the governing issue is how to overcome the barge heave motions during the mating phase and during the separating phase. Vessel heave motions are caused primarily by significant wave heights (Hs) and peak wave periods (Tp). In a calm water condition for a floatover installation operation with a defined wave height Hs, the Tp is usually in a small range (5~8 seconds) and the wave length is usually much less than the length of a floatover vessel. Under such conditions, the vessel maximum heave motion is usually less than 0.5 m (about 1.5 ft). Swells are long period waves (Tp about 10~14 seconds) generated from a long distance away. The wave length of a swell is much greater than the length of a floatover vessel and the vessel heave natural period is usually in the range of 10~12 seconds, very close to the Tp of swells. Therefore, the heave motions of a floatover vessel under swells are usually very high (0.5~1.2 m, about 1.5 ft~4 ft).

Over the last 30 years in offshore installation fields, more than 50 floatover installations have been successfully conducted. Different types of methods have been utilized and compared. Finally, two basic types of floatover methods have gained offshore industry general acceptance. The High-Deck method has been employed in the majority of successful floatover installations so far under open calm water conditions. Under swell conditions, the Uni-Deck method with an active hydraulic jacking system has been employed on the majority of successful floatover installations. The advantages and disadvantages of these two floatover installation methods are described below:

1. High-Deck method is a passive system employing stacked elastomeric elements on both the mating surfaces (Leg Mating Units, LMU) and the separating surfaces (Deck Support Units, DSU). The LMUs absorb initial mating impacts and facilitate load transfer under heave motions and the DSUs absorb impacts during the separation. Ballasting operation is employed in the load transfer process to transfer the deck load from the separating surfaces to the mating surfaces. The entire load transfer process typically lasts only 6~8 hours, completing within a tide cycle.
   a. Advantages: This system is a simple and passive system; the system reliability is high without potential high impacts. In addition, this method is relatively inexpensive comparing with other existing floatover methods for a floatover installation under a similar environment.
   b. Disadvantages: There are two major disadvantages for this method: 1) this method and system are only suitable for relative calm waters with the maximum vessel heave motions less than 0.5 m (about 1.5 ft); 2) these expensive LMUs are designed for one time use only.
2. Uni-Deck method is designed to conduct a floatover installation under swell conditions. Under typical West Africa offshore swell conditions, a floatover installation could face heave motions in the range of (0.5~1.2 m, about 1.5 ft~4 ft). Under such high heave motions, conventional High-deck method could not be employed because LMUs and DSUs have to be stacked very high and the barge draft variations have to become very large in order to accommodate such high heave motions during the mating and separating operations. In a typical Uni-Deck application, the LMUs are designed with two spring rates in order to shorten the height of stacked elastomeric elements as much as possible. The DSUs are replaced with a plurality of hydraulic lift jacks, capable of lifting the whole deck up to 2 meters (about 6 ft). Prior to entering the substructure slot, these jacks are extended to lift the deck upwardly to create additional air gaps between the downwardly extending deck leg bottoms and the substructure upwardly extending leg tops at mating surfaces. During the mating phase, the combination of ballasting and the deck lowering by these jacks at separating surfaces to limit the maximum impact loads at these mating surfaces. During the separation phase, all jacks are required to lower the deck at the same time and to quickly create sufficient air gaps at all separating surfaces. Steel-to-steel contact is not allowed at any separating surfaces, in order to avoid any potential damages both to the deck structure and to these supports at vessel deck.
   a. Advantages: this system is capable to perform a floatover installation under swell conditions.
   b. Disadvantages: the key disadvantage of this system is that the system is an active system employing expensive hydraulic jacks and a complicated control system. For this system, the most critical phase is the separation phase wherein these jacks have to act together and to separate the deck with the supports within a very short time period, typically 2 meters within 2 minutes. If the jack lowering operation could not be executed properly and sufficient enough, such as one jack could not be lowered along with other jacks together, steel-to-steel impact could happen with damages to both the deck and to the supports. Such events did occur more than once in West Africa floatover installations to produce so called "near miss" accidents. Another disadvantage is that the system is an expensive one including the costs of utilizing these jacks and the associated controlling system during the installation, the pre-installation testing and the removal of these jacks, plus the expensive maintenance costs.

Therefore there is a need for a simple, inexpensive and reliable system capable of performing floatover installation in all environmental conditions including both calm water conditions and well conditions.

SUMMARY OF THE INVENTION

A pneumatic load-transfer system and method for mating an integrated deck with a pre-installed platform substructure using a special type of air bags, called launching air bags (SLAB), is disclosed herein.

The pneumatic load-transfer system disclosed herein is a passive system capable of performing a floatover installation in both swell conditions and calm water environments with high reliability. The disclosed system is less expensive comparing with existing floatover methods. The major improvement of the present disclosure is to provide a pneumatic system at separating surfaces to perform multiple functions such as deck heave motion reduction, air gap enhancement, shock absorbing and the ability to adjust vertical support stiffness easily.

In accordance with one aspect of the present disclosure, the system provides a layer of air pads composed of a plurality of SLABs between the tops of supports at a vessel deck and the bottom surfaces of a platform deck. When air is injected to all SLABs at the same time and with the same pressure, these SLABs can be expanded to lift the deck upwardly generating an air gap quickly between the supports and the deck. The layer then becomes a spring in a series arrangement with the water plane spring acting at the floatover vessel. Once the air gap is stabilized, the deck will achieve a stable heave motion by its own and telescopic sleeves are installed between the upper covers of these SLABs and the bottom covers of these SLABs to ensure the stability of the deck against wind induced forces, during its own heave motions. Two favorable consequences are resulted to the deck heave motions: 1) a relative heave motion is created between the deck and the vessel to cause the reduction of relative heave motions between the deck and the re-installed substructure at mating surfaces; 2) the dynamic inertial force, generated by the relative heave motions between the deck and the vessel, can be utilized to reduce the vessel heave motion with a proper adjustment of the stiffness of this layer of air pads.

In accordance with another aspect of the present disclosure, the stiffness adjustability of the layer of SLAB air pads can be utilized to suit different environmental conditions at an installation site. Based on the site existing environmental conditions (Hs and Tp), the stiffness of the layer can be adjusted to achieve a minimum heave motion of the deck under the site waves, relative to the installed substructure and prior to the entering of the substructure slot. In this manner, expensive LMUs in a traditional High-Deck method could be replaced with inexpensive sand cans and most floatover installation related apparatuses can be reused for other floatover applications to further reduce the total floatover installation system costs.

In accordance with a further aspect of the present disclosure, the system is a simple and passive system without the employment of powerful hydraulic systems and other mechanical devices. The load transfer process, both in mating and separating phases, is conducted through the combination of a simple ballasting operation and a simple set of air releasing/injecting operations. Therefore, the reliability of the whole system is improved significantly, especially for the separating operation where any steel-to-steel contact is NOT allowed. With the improvement of the system reliability, the safety of the associated floatover installation is also improved.

The above-mentioned superior features and advantages of the present disclosure, together with other important aspects thereof will be further appreciated by those skilled in the art upon reading the detailed description which follows in conjunction with these drawings listed below.

BRIEF DESCRIPTION OF THE DRAWINGS

The drawings described herein are for illustrating purposes only of selected embodiments and not all possible implementations, and are not intended to limit the scope of the present disclosure. For further understanding of the nature and objects of this disclosure reference should be made to the following description, taken in conjunction with the accompanying drawings in which like parts are given like reference materials, and wherein.

DETAILED DESCRIPTION OF THE EMBODIMENTS

Shipbuilding in sand beaches started in 1980's in Southern China. Builders place wood blocks on sand beach and start ship construction on the tops of these blocks with the utilization of land cranes. When the construction is complete, a special type of air bags, Ship Launching Air Bags (SLAB), is placed under the ship keel longitudinally between two rows of wood blocks. Injecting air to these SLABs and the whole ship can be lifted off these wood blocks. After the lifting operation, these wood blocks can be then removed off the ship keel. Once cutting holding lines, the ship will be moved toward the sea along with the rolling of these SLABs.

The ship launching method described above has been successfully used in China for over 20 years. Recently, the applications of SLAB have expanded to other areas, such as ship salvages and a floatation tool for the transportation of a large concrete structure for a bridge. Over the years, SLABs have become a mature, reliable and off shelf product in shipbuilding industry with excellent characteristics, such as light in weight, durable, scratch resistant, and tolerant of high internal pressure, etc. Specifications of SLAB fabrications and ship launching operations using SLABs in shipbuilding industry have been widely published.

Figure 1A:
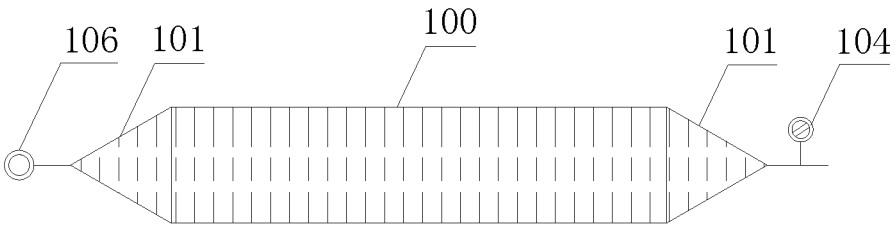
FIG. 1A (Prior Art)
FIG. 1A is a side view of a conventional Ship Launching Air Bag (SLAB)
Figure 1B:
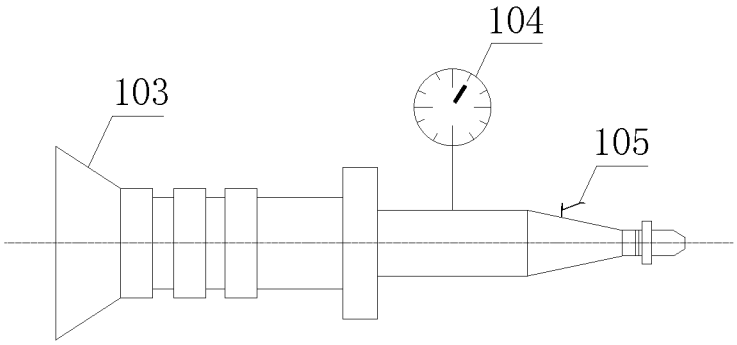
FIG. 1B (Prior Art)
FIG. 1B is a side view of a front end steel cone structure of the conventional SLAB in FIG. 1A with additional attachments such as a pressure meter and one air valve. The back end steel cone is similar with a ring attached at the end and without the pressure meter and the air valve.

FIG. 1A illustrates one embodiment of a standard SLAB 100. As shown in FIG. 1A, a standard SLAB is made of a tubular middle section and a cone section at each end: a front cone section 101 and a back cone section 101. The length of the middle section varies for each application. As shown in FIG. 1B, the front cone section 101 comprises a steel cone structure 103 covered with rubber layers with several attachments such as an air valve 105 for air inlet and exit, and an air pressure meter 104. The back end steel cone is similar to the front cone section with a steel ring 106 attached at the end for handling the SLAB 100. The back end cone section does not have the pressure meter or the air valve. The middle section and the surfaces of the two end sections are covered with nature rubbers mixed with several layers of polyester nets. With this assembly, each SLAB 100 becomes a flexible pressure vessel.

When the air bag is assembled, it will be put into a sealed container with high temperature for a designed duration with a vulcanization process to make the rubber layers tightly bonded with the cone steel surfaces at two ends and the rubbers bonded with the layers of polyester nets at the middle section.

SLAB is a mature product and it has several unique characteristics suitable for floatover installation applications:

1. Each SLAB is capable of bearing and lifting a heavy load when the SLAB is injected with air. In a typical ship launching application, a SLAB (2 m O.D.×20 m in length) is usually designed to take an 800-ton concentrated dynamic load during a ship launching process, a comparable load capacity as a hydraulic lift jack;
2. Each SLAB is a nature shock-absorbing spring to take dynamic impact loads when injected with air, a similar property as a stacked elastomeric shock-absorbing spring;
3. Each SLAB vertical stiffness can be easily and quickly changed with the variations of internal air pressure, a similar property as a hydro-pneumatic cylinder;
4. Reusable at a low cost—SLAB is a low cost product and it is designed to be for multiple uses. Based on shipbuilding industry records, it can be used for ship launching up to 50 times over a 10-year period or longer with little maintenance cost which further reduce the total cost for each individual application.

Embodiments of the present disclosure utilize multiple SLABs to form a layer of air pads at the separating surfaces. Instead of using multiple supports with a concentrated load at each of these separating surfaces, this layer of SLAB air pads provides a uniform load distribution over a large area of the deck bottom surfaces. This layer of SLAB air pads provides several functions during the mating and the separating phases of a floatover installation: 1) to function as a lift cylinder to elevate the deck to create sufficient air gaps at mating surfaces; 2) to function as a motion-damper spring with adjustable spring rates to reduce deck relative heave motions relative to the pre-installed substructure and as a shock-absorbing spring to reduce impact loads at both at the mating surfaces and at the separating surfaces; 3) to function as a retractable support to generate an air gap quickly, through releasing the air inside all SLABs at the same time, at the separating surface.

Air injection to all SLABs at the same time requires a large value of compressed air within a short time period. Therefore, a pressure vessel is usually required as an accumulator to provide an accurate air pressure to each SLAB during the floatover operation. During the air releasing, a designed system should be able to stop air releasing when a designed air pressure is reached.

Swells are usually directional. Therefore, the orientation of a jacket under a swell environment is designed accordingly to suit the swell directions. In a normal environment for a floatover installation, a designer should consider waves from all directions. In a swell environment, a designer usually consider a small range of headings based on the swell dominate directions, usually a heading sea plus +/−30 degrees.

Figure 2A:
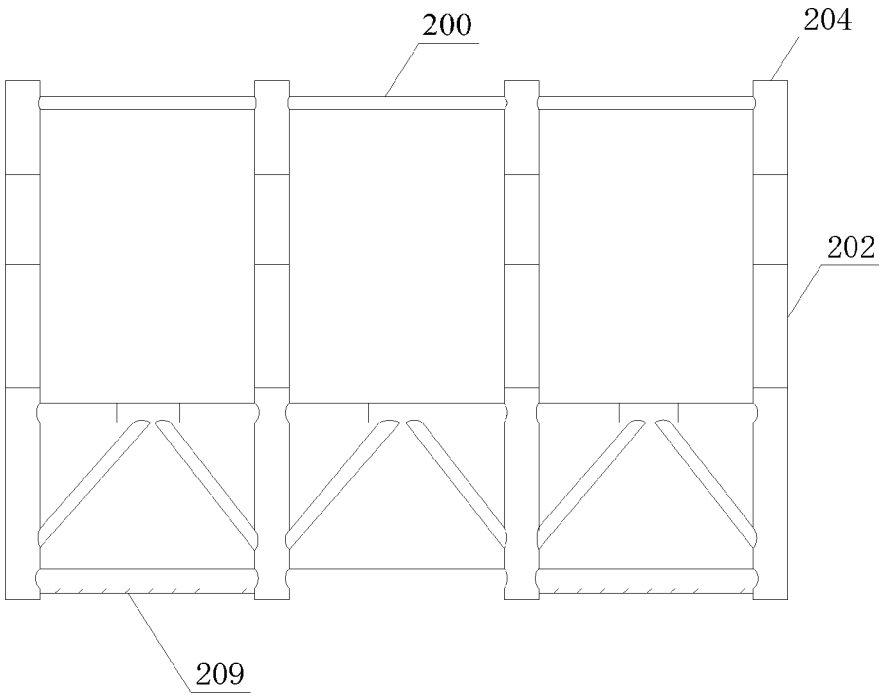
FIG. 2A is a side elevation view of a shallow water jacket with an open slot.
Figure 2B:
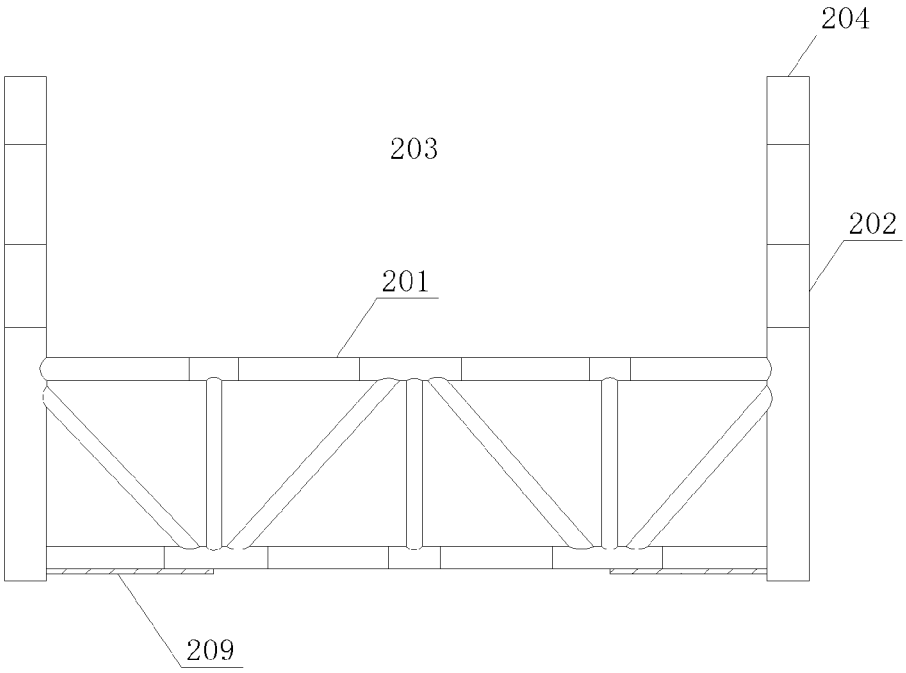
FIG. 2B is a front elevation view of a shallow water jacket.

Referring now to FIG. 2A to FIG. 2B, a shallow water jacket 200 front elevation view and a side elevation view are illustrated respectively. The shallow water jacket 200 comprises horizontal structural members 201 and upwardly extending jacket main leg members 202. Eight jacket main legs 202 form an open slot 203 for the entry of a transport vessel 210 during a docking operation. At the top of each jacket main leg 202 is the mating surface 204 used for a load transfer operation during a floatover installation.

Figure 3A:
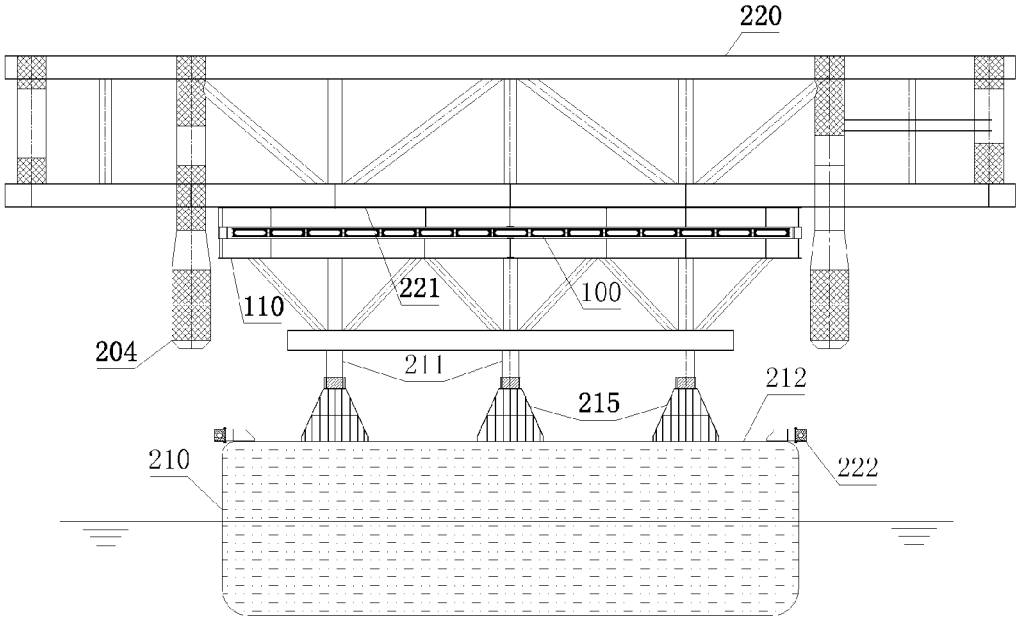
FIG. 3A is a side elevation view of a transport vessel loaded with an integrated deck during transportation.

FIG. 3A is a side elevation view of a transport vessel 210 loaded with an integrated deck 220 during transportation. The transport vessel 210 has a set of transverse fenders 222 secured on the vessel deck 212. A support structure composed of skid shoes 211 and skidbeams 215 is located on the vessel deck 212. A layer of air pads 110 composed of a plurality of SLABs 100 is placed between the support structure and the separating surfaces 221 at deck bottoms.

Figure 3B:
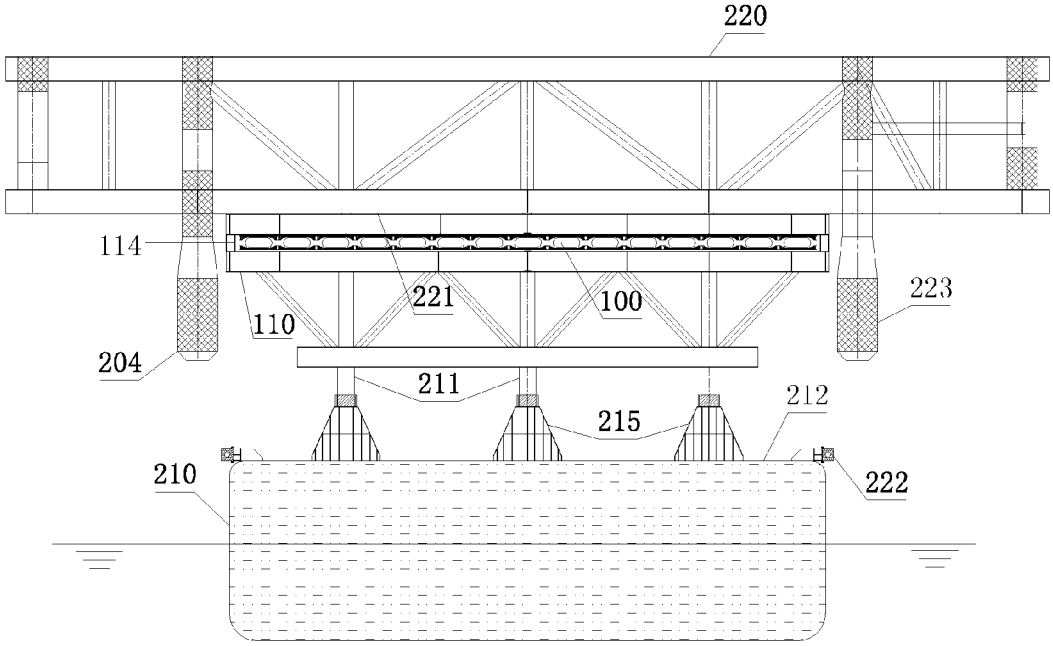
FIG. 3B is a side elevation view of a transport vessel loaded with an integrated deck at the installation site with the deck is lifted to increase the air gap for mating operation, prior to the entering of the jacket slot.

After the transport vessel arrives at an installation site, a floatover installation operation will have to wait for a weather window suitable for installation. Once a suitable weather window is confirmed, the floatover installation operation will commence with a proper ballasting of the vessel 210 to a design draft and trim. Air will then be injected into all SLABs 100 in the layer of air pads 110 quickly to a preset air pressure level, as a result, the deck 220 is then lifted to a height with motions relative to the vessel deck 212, as shown in FIG. 3B. During this operation, the layer of air pads 110 functions as a spring to provide a uniformly distributed support at the deck separating surfaces 221.

In accordance with one embodiment, a motion monitoring system is installed at the vessel deck 212 to monitor the relative motions between the deck 220 and the pre-installed jacket 200 at mating surfaces 204 and between the deck 220 and the vessel deck 212. The spring rate of the layer of air pads 110 is dependent on the internal pressure of these SLABs 100. The higher the air pressure, the higher the vertical stiffness. In order to achieve a minimal relative motion between the deck 220 and the pre-installed jacket mating surfaces 204, air in SLABs 100 may be initially injected to a preset pressure level higher than the desired internal air pressure for the intended mating operation. After the relative motions are stabilized, internal air of the SLABs 100 could be released slowly and the vertical stiffness of the layer of air pads 110 is gradually reduced until a minimal relative motion is achieved.

Figure 4A:
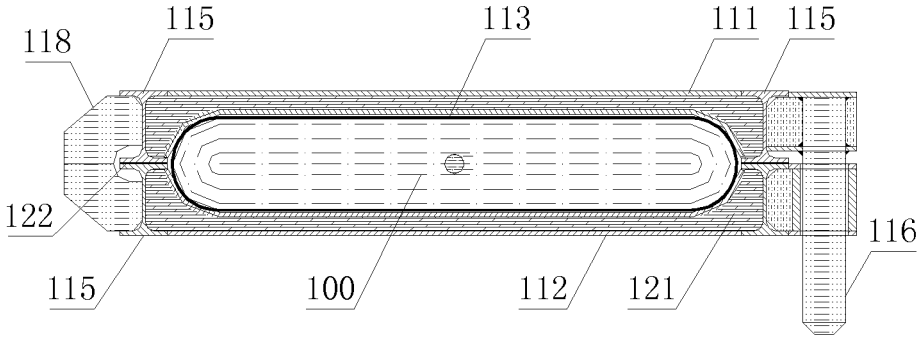
FIG. 4A is a front view of one individual SLAB with an upper cover and a lower cover at a transportation configuration.
Figure 4B:
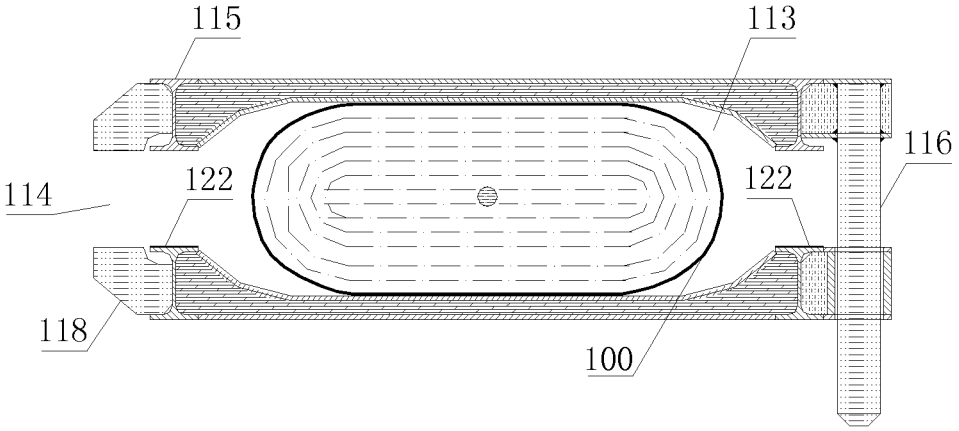
FIG. 4B is a front view of one individual SLAB with an upper cover and a lower cover at a high elevated configuration with a large deck elevation variation range, suitable for a floatover installation under a swell environment.
Figure 4C:
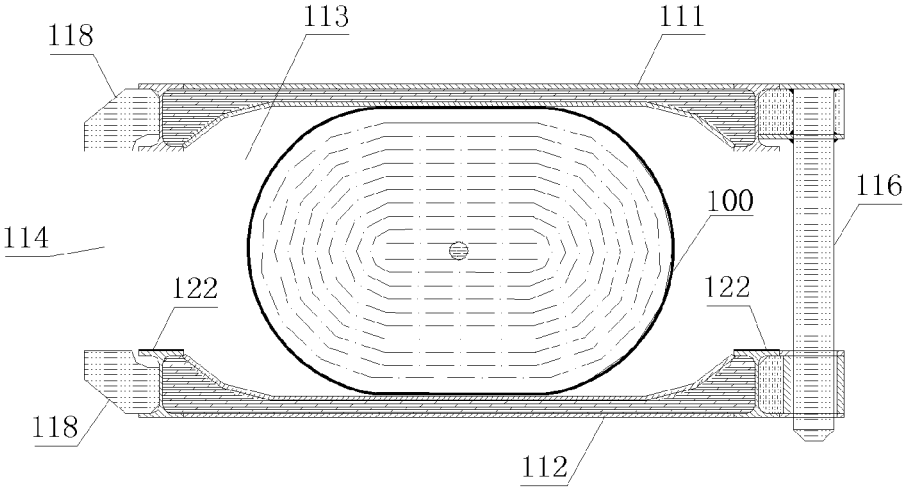
FIG. 4C is a front view of one individual SLAB with an upper cover and a lower cover at a low elevated configuration with a small deck elevation variation range, suitable for a floatover installation under a calm water environment.

Referring to FIG. 4A through FIG. 4C, the basic functions of one individual housing 113 with a SLAB 100 in 3 different configurations are illustrated. In FIG. 4A, one single SLAB 100 is inside an elliptical shaped housing 113 in a transportation configuration with a designed internal air pressure in accordance with one embodiment. The housing 113 comprises an upper cover structure 111 and a matching lower cover structure 112. The upper cover 111 and the lower cover 112 are composed of I-beams 115 and plates 121. The I-beams 115 at the upper cover are aligned with the deck bottom I-beams so that the deck load may be passed directly to the SLABs 100 and the skid shoes 211/skidbeams 215 at the vessel deck 212. Rubber strips 122 are placed at the contact surfaces between I-beam 115 of the upper cover 111 and I-beam 115 of the lower cover 112 to provide an enhanced safety.

On the right side of the housing 113, there is a telescopic device 116 between the upper cover 111 and the lower cover 112. The telescopic device 116 helps to maintain the stability of the deck during the lifting/lowering and under the loads of winds during the relative vertical motions of the upper cover 111 and the lower cover 112. On the left side of the housing 113, clip plates 118 are utilized to tie the upper cover 111 and the lower cover 112 together during the transportation.

In FIG. 4B, the internal air pressure of the SLAB 100 is sufficient to lift the deck up after the clip plates 118 are cut off; therefore, the relative heave motions between the upper cover 111 and the lower cover 112 are relatively small. This configuration is generally used for a floatover installation application under a calm water environment. FIG. 4C illustrates the configuration for a floatover installation application under a swell environment where larger relative heave motions and higher internal air pressure variations inside the SLABs 100 are expected.

Figure 4D:
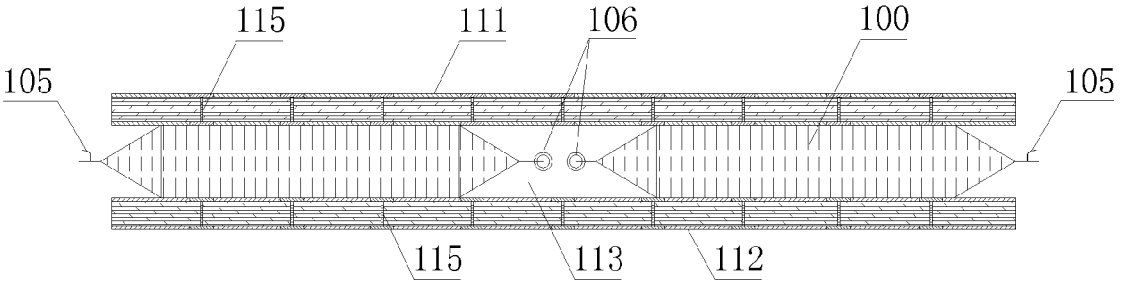
FIG. 4D is a cross section view of one pair of SLABs with an upper cover and a lower cover at a transportation configuration.

Referring to FIG. 4D, this is a cross section view of two SLABs 100 placed inside one housing 113 in a transportation configuration. At each side of the housing 113, an air valve 105 is included for each SLAB 100 for air injection and release. At the other end of each SLAB 100, a steel ring 106 is attached. SLABs 100 may have different lengths. In accordance with one embodiment, the SLAB 100 Horizontal Center of Geometry (HCoG) may be adjusted to match with CoG of the deck 220 in the horizontal plane vertically by using SLABs in different lengths. I-beams 115 at the tops of the upper cover 111 should be aligned with the beams at deck 220 bottom.

Figure 5A:
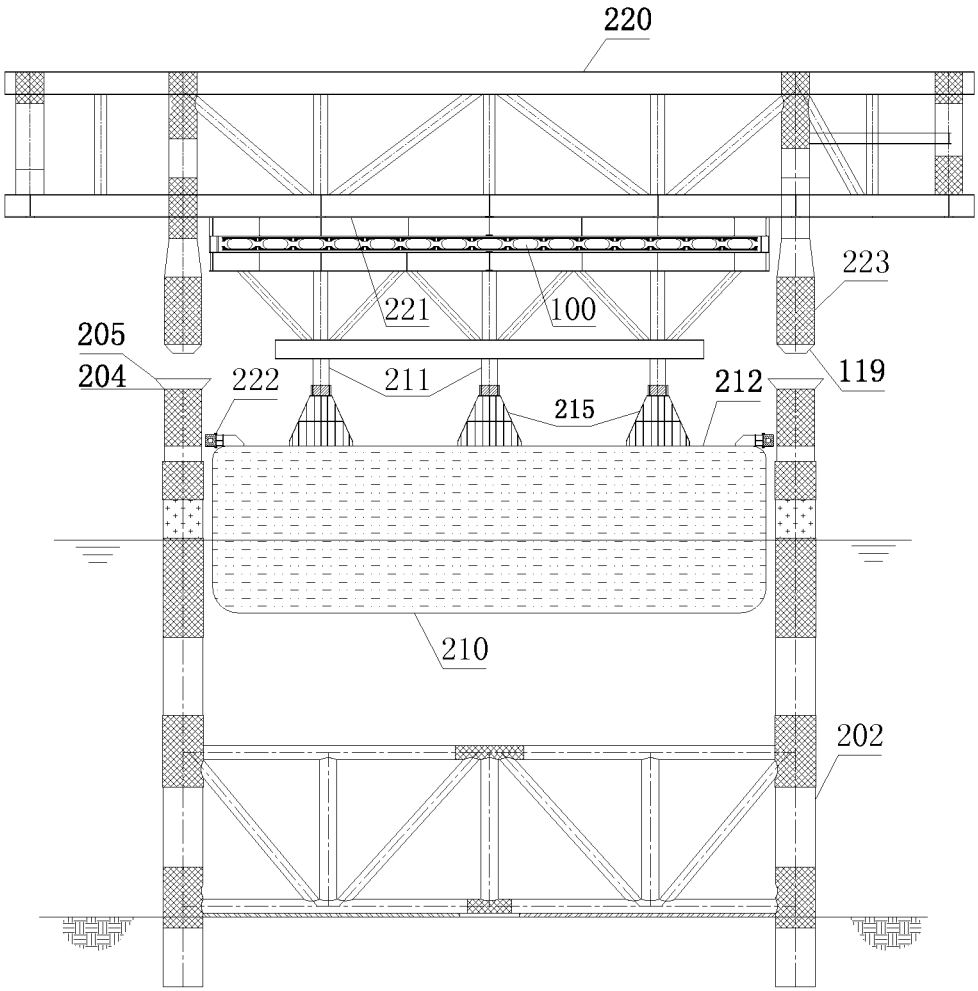
FIG. 5A is a side elevation view of a transport vessel loaded with an integrated deck inside the jacket slot prior to a mating operation under a calm water environment.
Figure 5B:
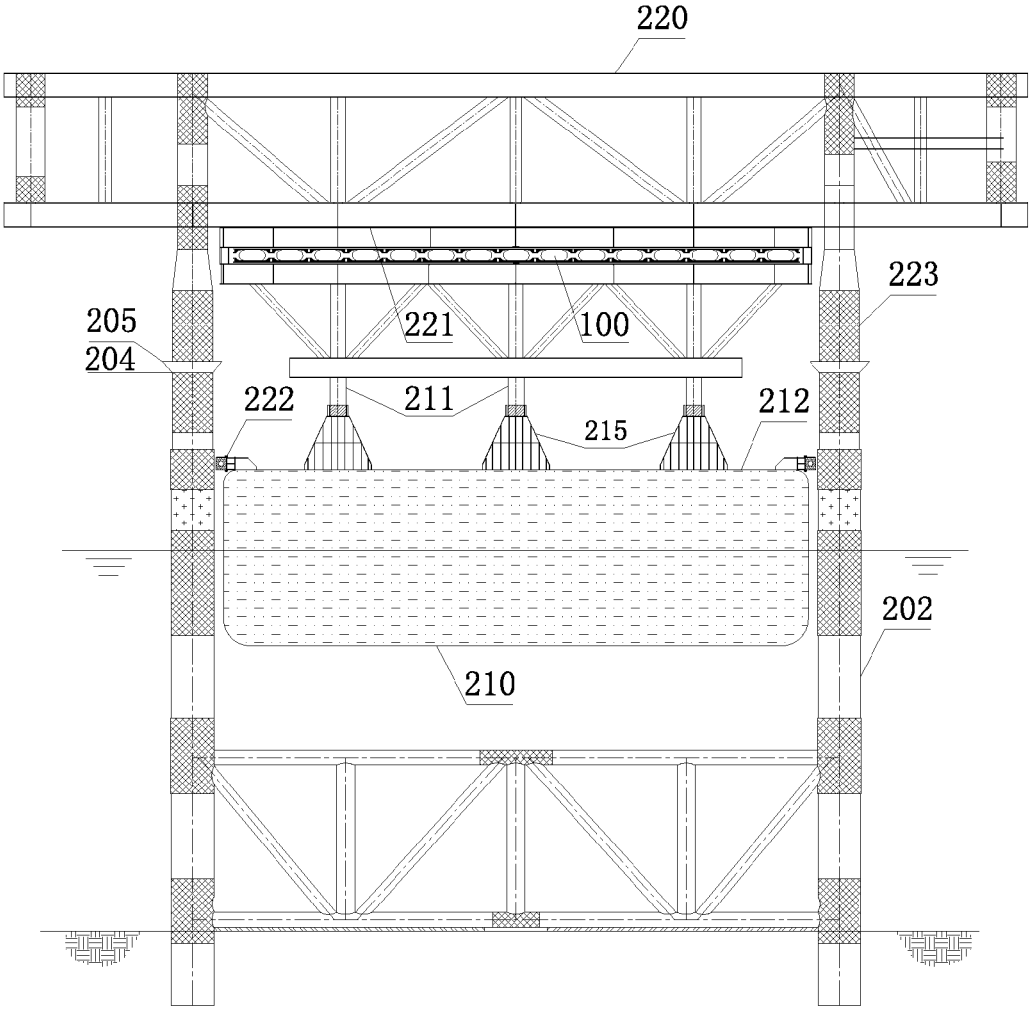
FIG. 5B is a side elevation view of a transport vessel loaded with an integrated deck inside the jacket slot during a load transfer operation under a calm water environment.
Figure 5C:
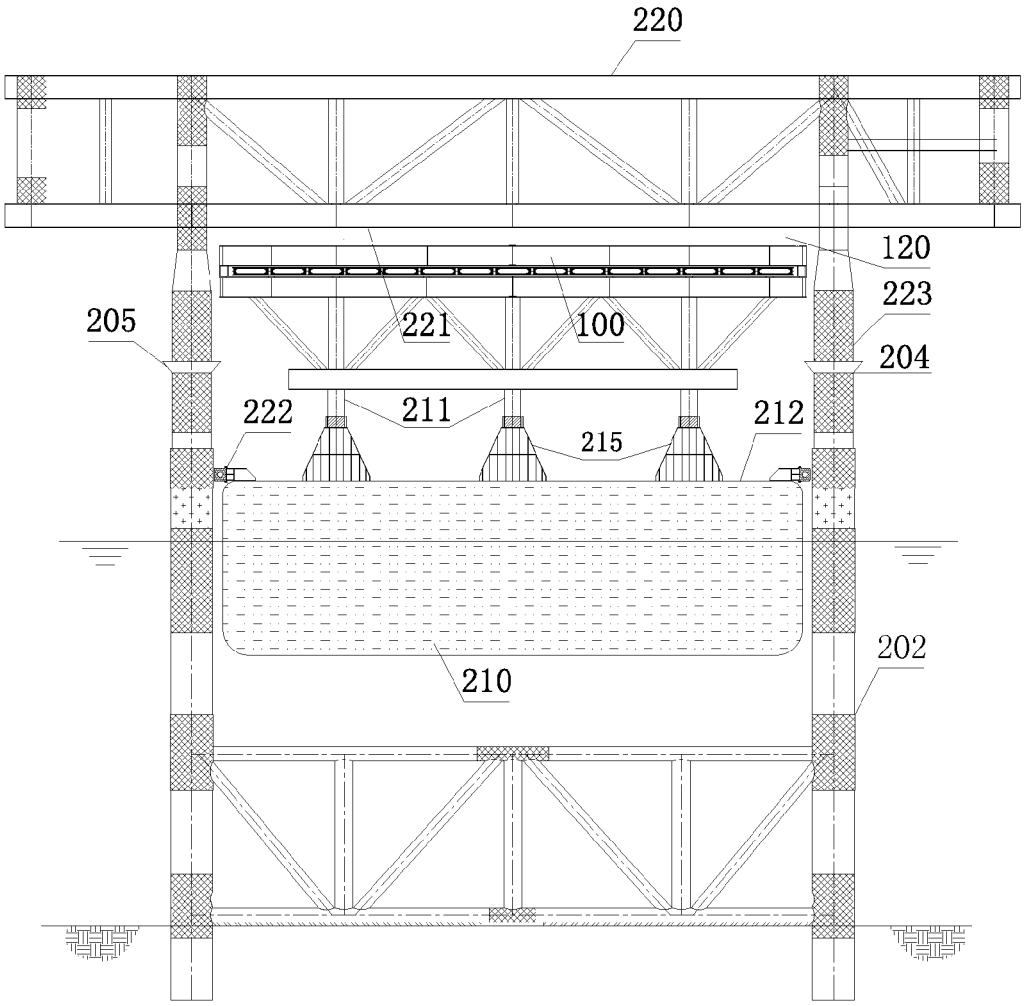
FIG. 5C is a side elevation view of a transport vessel loaded with an integrated deck inside the jacket slot at a post separation configuration under a calm water environment.

Referring to FIG. 5A through FIG. 5C, a set of floatover operational stages suitable for a calm water floatover application are illustrated. Looking at FIG. 5A, a pre-mating configuration is shown where a pin 205 (a sand can) is placed at the mating surface 204, at the top of each jacket main leg 202. A matching stabbing cone 119 is placed at the bottom of each downwardly extended deck leg 223. At the separating surfaces 221, proper SLABs 100 internal air pressures are maintained to keep the relative heave motions between the pin 205 and the stabbing cone 119 at a minimal Once the alignment between the pin 205 and the stabbing cone 119 falls within a required range, vessel ballasting may commence and the mating operation may begin.

FIG. 5B illustrates the moment that the stabbing cone 119 makes an initial contact with the sands inside the pin 205 as the ballasting of the vessel 210 continues in accordance with one embodiment. Air from all SLABs should be reduced quickly, less than one minute, to a preset pressure range in order to reduce the air gaps 114 and to make full contacts at these mating surfaces 204 without any separation.

Referring to FIG. 5C, a full separation is achieved with an air gap 120 at the separating surfaces 119. At this stage, 100% of the deck load is transferred from the separating surfaces 119 of the deck 210 to the mating surfaces 204 of the jacket 200. The internal air pressure for all SLABs will be further reduced in order to close the gaps 114. The transport vessel 210, without the deck 220 at this time, will start the withdrawal operation by exiting from the slot 203.

Figure 6A:
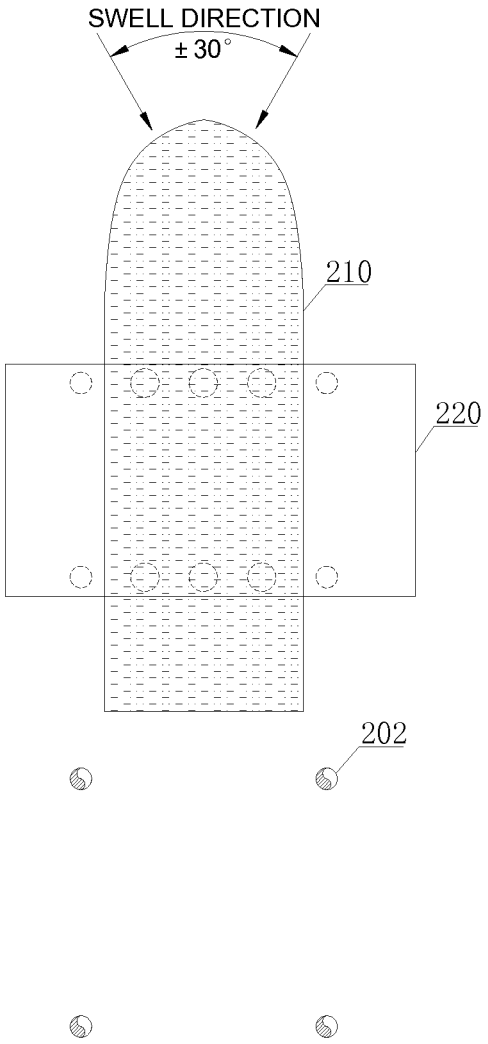
FIG. 6A is a plan view illustrating a transport vessel loaded with an integrated deck being ready to move in the jacket slot and the dominate swell directions considered in a floatover installation design.

FIG. 6A is a plan view of a transport vessel 210 loaded with an integrated deck 220 at an installation site under a swell environment in accordance with one embodiment. The orientation of the vessel 210 is based on the pre-installed jacket open slot 203 with the vessel stern facing the open slot 203. Only swell heading directions in the range of +/−30 degree are considered in the floatover installation design.

FIG. 6B through FIG. 6E are the site elevation views of a transport vessel 210 loaded with an integrated deck 220 with the illustration of a mating operational sequence inside the jacket open slot 203, during a load transfer operation and under a swell environment.

Figure 6B:
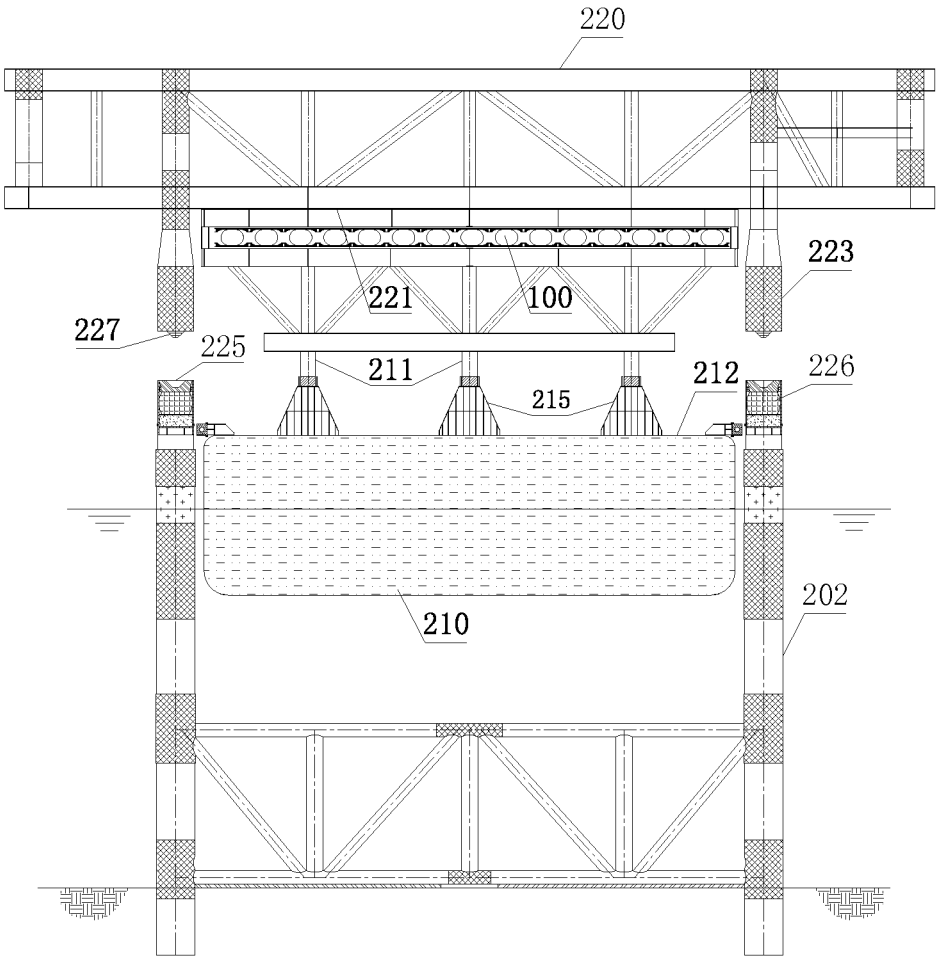
FIG. 6B is a side elevation view of a transport vessel loaded with an integrated deck inside the jacket slot prior to a mating operation under a swell environment.

Referring to FIG. 6B, a pre-mating configuration is shown. A stabbing cone 227 is placed inside each downwardly extended deck leg 223. A matching receptacle 225 to the stabbing cone 227 is placed inside the top of each jacket main leg 202, the mating surface 204. A LMU 226 is inside each main jacket leg 202, just below the receptacle 225. At the separating surface 221, a proper SLABs 100 internal air pressure is maintained to keep the relative heave motions between the stabbing cones 227 and the receptacles 225 at minimal Once the alignment between the stabbing cones 227 and the receptacles 225 at mating surfaces 204 falls within the required range, vessel ballasting may commence and the mating operation may begin.

Figure 6C:
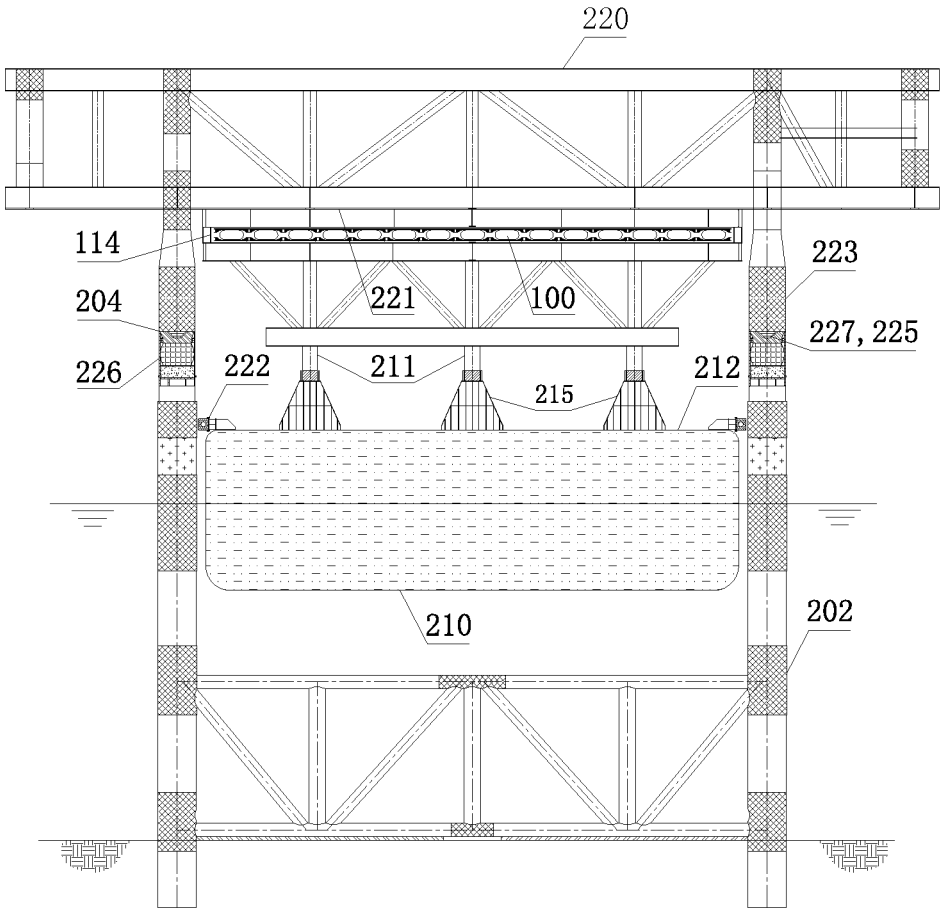
FIG. 6C is a cross section view of a transport vessel loaded with an integrated deck inside the jacket slot during a load transfer operation under a swell environment.

FIG. 6C illustrates the moment that the stabbing cone 227 makes an initial contact with the receptacle 225 at the mating surfaces 204 as the ballasting of the vessel 210 continues. Air from all SLABs may be released properly to reduce the SLAB internal pressure to a preset pressure range in order to reduce the air gaps 114. A positive air gap 114 should be maintained while making full contacts between the stabbing cone 227 and the matching receptacle 225 of LMUs 226 at these mating surfaces 204. After the full contact at these mating surfaces 204 is achieved, all LMUs 226 are activated to transfer the deck loads from the separating surfaces 221 to the mating surfaces 204 while the vessel 210 heave motions and vessel 210 ballasting continue. During this stage, proper air injection, by an accumulator, into the SLABs may be utilized to ensure the full contacts at both the mating surfaces 204 and the separating surfaces 221 until steel-to-steel contacts occur at mating surfaces 204.

Figure 6D:
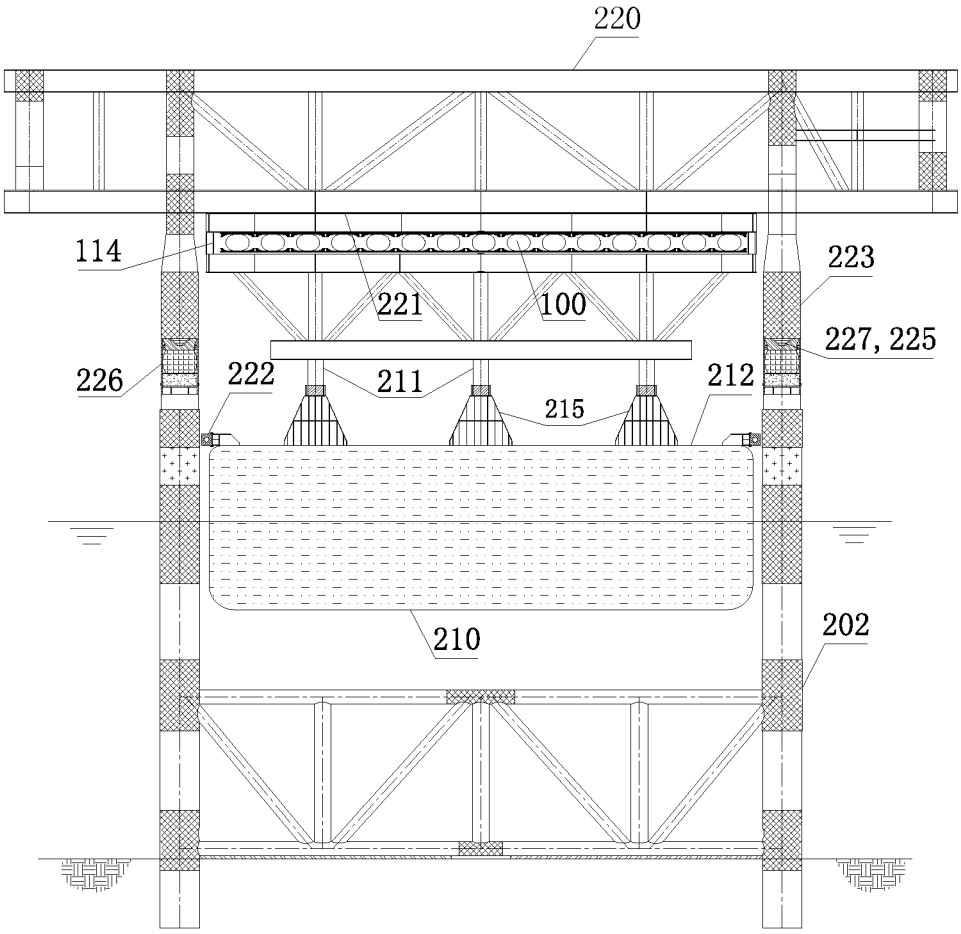
FIG. 6D is a side elevation view of a transport vessel loaded with an integrated deck inside the jacket slot at an initial separation configuration under a swell environment.

Referring to FIG. 6D, when the steel-to-steel contacts occur with a large percentage of load transfer being achieved, air inside all SLABs 100 should be released quickly to a preset internal air pressure, preferably within a minute, in order to achieve permanent contacts at these mating surfaces 204 and non-continuous contacts at the separating surfaces 221.

Figure 6E:
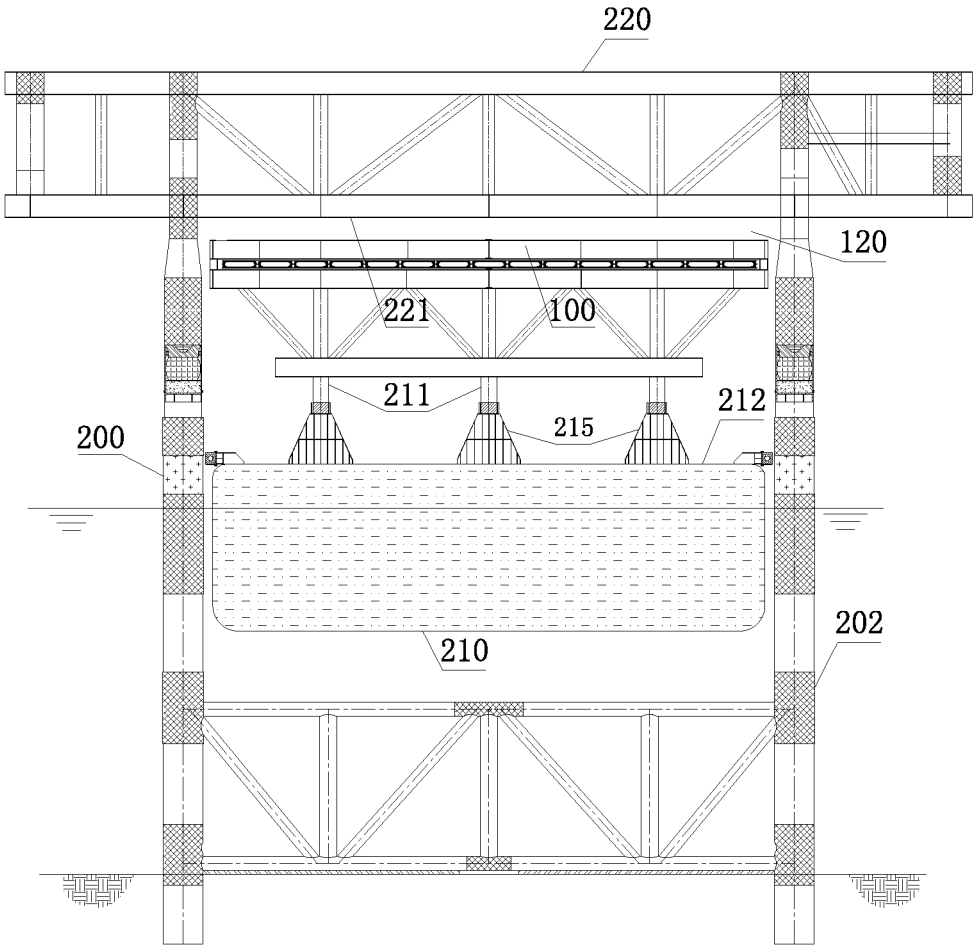
FIG. 6E is a side elevation view of a transport vessel loaded with an integrated deck inside the jacket slot at a post separation configuration at the separation surfaces under a swell environment.

Referring to FIG. 6E, a full separation is achieved with a sufficient air gap 120 at the separating surface 221 when the designed vessel free-board is achieved. At this stage, 100% of the deck load is transferred from the separating surfaces 221 of the deck 220 to the mating surfaces 204 of the jacket 200. The internal air pressure for all SLABs 100 will be further reduced to a minimal with the air gap 114 being totally closed. The transport vessel 210, without the deck 220, will start the withdrawal operation by exiting from the slot 203.

Figure 7:
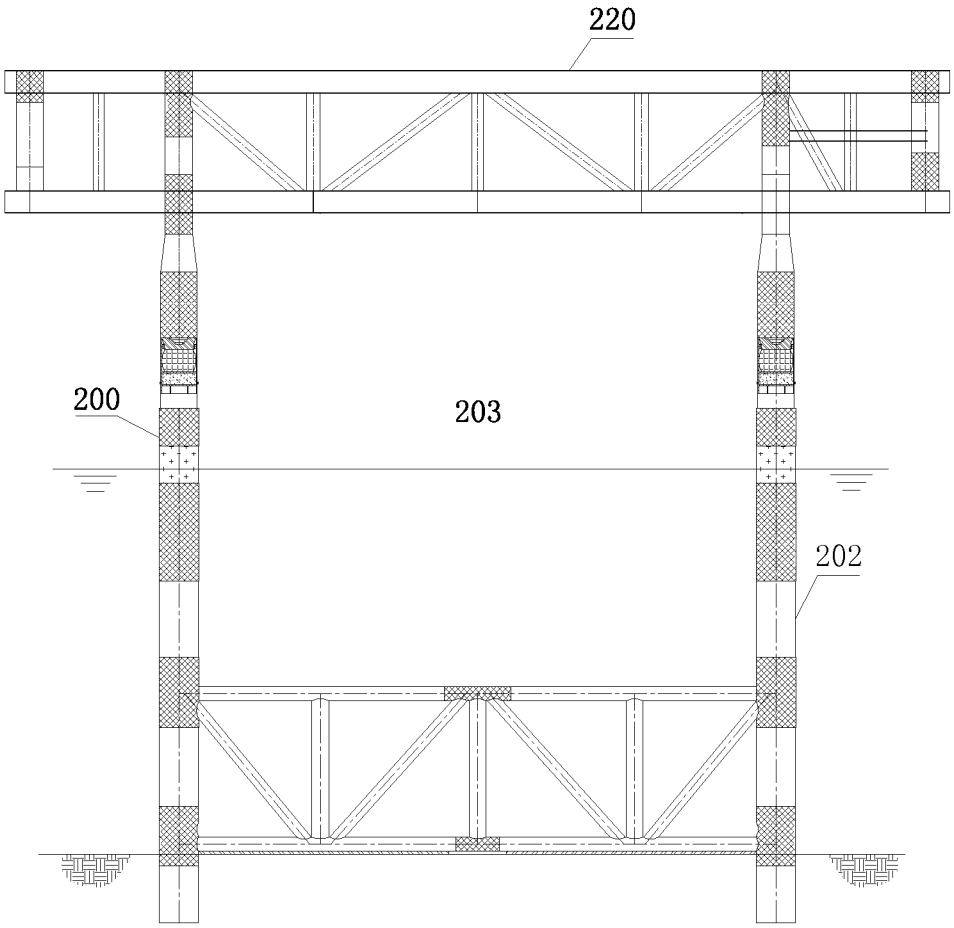
FIG. 7 is a side elevation view of an installed offshore platform in a post installation configuration.

Referring to FIG. 7, a post floatover installation configuration is shown with an installed platform.

Although a preferred embodiment of a system and method in accordance with the present invention have been described herein, respectively, those skilled in the art will recognized that various substitutions and modifications may be made to the specific features described without departing from the scope and spirit of the invention as recited in the appended claims.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A pneumatic load-transfer system for an offshore floatover installation comprising:

a transport vessel having a transport vessel deck loaded with a module for transporting the module to an offshore installation site;

a support structure situated on the transport vessel deck to provide rigid support to the transported module during transportation of the module; and a plurality of air bags horizontally placed inside a layer of housings located between the bottom of the loaded module and the top of the support structure to provide flexible support to the module during installation, wherein the load of the module is uniformly distributed among the plurality of air bags, wherein the flexible support is equipped with telescopic structures against lateral loading and is able to provide adjustable spring rate during installation;

wherein the load of the module is transferred from the support structure to a plurality of main legs of a preinstalled jacket contacted at a plurality of mating surfaces through a plurality of mating apparatuses.

2. The pneumatic load-transfer system according to claim 1, wherein each air bag has a minimal internal air pressure during transportation of the module.

3. The pneumatic load-transfer system according to claim 1, wherein there is no relative motion between the module CoG and the transport vessel CoG in vertical direction during the transportation of the module.

4. The pneumatic load-transfer system according to claim 1, wherein the plurality of air bags are injected with air to life up the module and form the flexible support to the module at the installation site.

5. The pneumatic load-transfer system according to claim 4, wherein relative motions occur between the module CoG and the transport vessel CoG during a mating operation.

6. The pneumatic load-transfer system according to claim 4, wherein relative motions between the module CoG and the vessel CoG in vertical direction may be adjusted by adjusting internal air pressure of the plurality of air bags.

7. The pneumatic load-transfer system according to claim 4, wherein spring rate of the flexible support is adjustable by adjusting internal air pressure of the plurality of air bags.

8. The pneumatic load-transfer system according to claim 1, wherein the load-transfer operation is accomplished by the transport vessel ballasting and a set of controlled air injection and release operations for the plurality of air bags.

9. The pneumatic load-transfer system according to claim 1, wherein each air bag is made of nature rubber and multiple layers of polyester nets bonded together through a vulcanized process.

10. The pneumatic load-transfer system according to claim 1, wherein each air bag comprises a middle tubular section and a cone section at each end, wherein one end of the air bag comprises an air injection and release valve.

11. The pneumatic load-transfer system according to claim 1, wherein the housing has an elliptical cross section shape.

12. The pneumatic load-transfer system according to claim 11, wherein the housing comprises an upper cover structure and a lower cover structure, wherein the upper cover structure and the lower cover structure are physically connected during transportation of the module, and wherein the upper cover structure and the lower cover structure are disconnected during the load transfer operation.

13. The pneumatic load-transfer system according to claim 12, wherein the housing further comprises a telescopic device to allow sliding action between the upper cover structure and the lower cover structure during the load transfer operation.

14. The pneumatic load-transfer system according to claim 1, wherein the mating apparatus at each mating surface comprises a bin containing sands as a shock absorbing material at the top of a jacket main leg and a stabbing cone at the bottom of a deck main leg.

15. The pneumatic load-transfer system according to claim 1, wherein the mating apparatus at each mating surface comprises a set of stacked elastomeric elements inside a tubular leg and a stabbing cone and a matching receptacle.

16. The pneumatic load-transfer system according to claim 1 further comprising a pressure vessel containing compressed air placed at the transport vessel deck to provide compressed air to the plurality of air bags.

17. The pneumatic load-transfer system according to claim 1 further comprising a central control system connected to the plurality of air bags to control injection and release of air.

18. The pneumatic load-transfer system according to claim 1, wherein the module is an integrated platform deck.

19. The pneumatic load-transfer system according to claim 1, wherein the plurality of air bags are divided into several air bag groups and interconnected with a common air injection and release control system to maintain a uniformed internal air pressure in all air bags.

20. The pneumatic load-transfer system according to claim 19, wherein each air bag group has a check valve to protect other air bag groups in case there is an air leaking in one air bag of an air bag group.

21. A method for transferring a module having a plurality of downward extending legs during an offshore floatover installation using a load-transfer system, the load-transfer system having a transport vessel with a transport vessel deck, a support structure situated on the transport vessel deck, and a plurality of air bags horizontally placed inside a layer of housings located between the bottom of the module and the top of the support structure, the load of the module is transferred from the support structure to a plurality of main legs of a preinstalled jacket contacted at a plurality of mating surfaces through a plurality of mating apparatuses, the method comprising:

transporting the module via the transport vessel to an offshore installation site with a pre-installed jacket having a plurality of upward extending legs;

injecting air to the plurality of air bags to life up the module and form a flexible support to the module;

aligning the mating surfaces;

ballasting the transport vessel;

properly reducing the internal air pressure of the plurality of air bags to make full contacts at the mating surfaces without any separation;

further reducing the internal air pressure of the plurality of air bags to a minimal; and exiting the transporting vessel from the slot formed by the upward extending jacket legs without the module;

wherein the load of the module is uniformly distributed among the plurality of air bags during installation;

wherein the flexible support is equipped with telescopic structures against lateral loading and is able to provide adjustable spring rate during installation.

22. The method according to claim 21, wherein each air bag has a minimal internal air pressure during transportation of the module.

23. The method according to claim 21, wherein there is no relative motion between the module CoG and the transport vessel CoG in vertical direction during the transportation of the module.

24. The method according to claim 21 further comprising adjusting internal air pressure of the plurality of air bags to change the relative motions between the module CoG and the transport vessel CoG during a mating operation.

25. The method according to claim 21, wherein spring rate of the flexible support is adjustable by adjusting internal air pressure of the plurality of air bags.

26. The method according to claim 21, wherein each air bag is made of nature rubber and multiple layers of polyester nets bonded together through a vulcanized process.

27. The method according to claim 21, wherein each air bag comprises a middle tubular section and a cone section at each end, wherein one end of the air bag comprises an air injection and release valve.

28. The method according to claim 21, wherein the housing has an elliptical cross section shape.

29. The method according to claim 28, wherein the housing comprises an upper cover structure and a lower cover structure, wherein the upper cover structure and the lower cover structure are physically connected during transportation of the deck, and wherein the upper cover structure and the lower cover structure are disconnected during the load transfer operation.

30. The method according to claim 29, wherein the housing further comprises a telescopic device to allow sliding action between the upper cover structure and the lower cover structure during the load transfer operation.

31. The method according to claim 21, wherein the mating apparatus at each mating surface comprises a bin containing sands as a shock absorbing material at the top of a jacket main leg and a stabbing cone at the bottom of a module main leg.

32. The method according to claim 21, wherein the mating apparatus at each mating surface comprises a set of stacked elastomeric elements inside a tubular leg and a stabbing cone and a matching receptacle.

33. The method according to claim 21, wherein the load-transfer system further comprises a pressure vessel containing compressed air placed at the transport vessel deck to provide compressed air to the plurality of air bags.

34. The method according to claim 21, wherein the load-transfer system further comprises a central control system connected to the plurality of air bags to control injection and release of air.

35. The method according to claim 21, wherein the module is an integrated platform deck.

36. The method according to claim 21, wherein the plurality of air bags are divided into several air bag groups and interconnected with a common air injection and release control system to maintain a uniformed internal air pressure in all air bag groups.

37. The method according to claim 36, wherein each air bag group has a check valve to protect other air bag groups in case there is an air leaking in one air bag of one group.

* * * * *